US007313983B1

(12) United States Patent
Book

(10) Patent No.: US 7,313,983 B1
(45) Date of Patent: Jan. 1, 2008

(54) BOTTLE OPENER

(76) Inventor: Steven C. Book, Suite D, 16th Floor, Flourish Manufactory Centre, 18 Tai Lee Street, Yuen Long, N.T. (HK)

( * ) Notice: Subject to any disclaimer, the term of this patent is extended or adjusted under 35 U.S.C. 154(b) by 0 days.

(21) Appl. No.: 11/475,466

(22) Filed: Jun. 26, 2006

Related U.S. Application Data

(60) Provisional application No. 60/698,803, filed on Jul. 12, 2005.

(51) Int. Cl.
*B67B 7/16* (2006.01)

(52) U.S. Cl. ..... 81/3.55; 81/3.07; 81/3.57

(58) Field of Classification Search ..... 81/3.07, 81/3.55, 3.57
See application file for complete search history.

(56) References Cited

U.S. PATENT DOCUMENTS

| | | | | | |
|---|---|---|---|---|---|
| D43,104 | S | | 10/1912 | Cary | |
| 1,899,203 | A | * | 2/1933 | Labreche | 7/151 |
| D116,179 | S | | 8/1939 | Yates, Jr. | |
| D118,329 | S | | 12/1939 | Crowley | |
| D143,233 | S | | 12/1945 | Moore | |
| 3,142,903 | A | | 8/1964 | Stiller | |
| 3,495,284 | A | | 2/1970 | Weingardt | |
| D247,263 | S | | 2/1978 | van Benthem | |
| D270,807 | S | | 10/1983 | Dilliner | |
| 4,409,863 | A | | 10/1983 | Anderson | |
| 4,412,464 | A | | 11/1983 | Cook | |
| D271,659 | S | | 12/1983 | Fayle | |
| D278,509 | S | | 4/1985 | Middleton et al. | |
| 4,617,842 | A | * | 10/1986 | Yang | 81/3.09 |
| 4,949,600 | A | * | 8/1990 | Tricinella | 81/3.09 |
| D311,667 | S | | 10/1990 | Cholagh | |
| 4,976,172 | A | | 12/1990 | Thomas et al. | |
| 5,069,090 | A | * | 12/1991 | Clark | 81/3.09 |
| 5,077,850 | A | | 1/1992 | Brubaker | |
| D325,499 | S | | 4/1992 | Wilder | |
| D326,040 | S | | 5/1992 | Wysopal | |
| D334,696 | S | | 4/1993 | Makris | |
| D339,968 | S | | 10/1993 | Shy | |
| D348,381 | S | | 7/1994 | Rutherford | |
| D356,237 | S | | 3/1995 | White | |
| D383,651 | S | | 9/1997 | Van Wyk | |

(Continued)

*Primary Examiner*—D. S. Meislin
*Assistant Examiner*—Shantese L. McDonald
(74) *Attorney, Agent, or Firm*—Todd N. Hathaway

(57) ABSTRACT

A compact, ergonomic, pocket-sized bottle opener having a thin, generally flat body. The bottom edge of the body includes a jaw opening and at least one area for receiving a lifting finger. A plug of resiliently yielding material is mounted in the finger-receiving area to cushion the lifting finger. A hook at the forward end of the jaw opening forms a fulcrum point for engaging the top of the bottle cap. The hook also serves to lift pull-tabs on cans. An opening at the rear of the body holds a key ring. The key ring can be slipped into the opening during assembly by flexing the leg so as to open a slot that separates the distal end of the leg from the body. The cushioning plug mounts over both the distal end of the leg and the lower edge of the body so as to hold the leg in place after the ring has been installed. The two sides of the body form broad, generally flat display surfaces for application of logos, advertising, or other information. The body is preferably formed of strong, molded plastic, with a metal insert being installed in the jaw opening for engaging the edges of bottle caps.

19 Claims, 9 Drawing Sheets

U.S. PATENT DOCUMENTS

| | | | |
|---|---|---|---|
| D383,954 | S | 9/1997 | Biunno |
| D404,268 | S | 1/1999 | Kennedy |
| D408,237 | S | 4/1999 | Wysopal |
| D421,372 | S | 3/2000 | Wysopal |
| D433,898 | S | 11/2000 | Hunt |
| D438,075 | S | 2/2001 | Van Meter |
| D438,768 | S | 3/2001 | Chiu |
| D439,816 | S | 4/2001 | Wysopal |
| D443,804 | S | 6/2001 | Wysopal |
| D444,685 | S | 7/2001 | Shenkel et al. |
| D463,234 | S | 9/2002 | Wysopal |
| D466,770 | S | 12/2002 | Kelleghan |
| D467,480 | S | 12/2002 | Kelleghan |
| D480,934 | S | 10/2003 | Hernandez |
| D485,431 | S | 1/2004 | Hsu |
| D497,087 | S | 10/2004 | Gallo et al. |
| D501,381 | S | 2/2005 | Kelleghan |
| D523,711 | S | 6/2006 | Ryan et al. |
| 7,086,310 | B2 | 8/2006 | Oleksy |

* cited by examiner

BOTTLE OPENER

RELATED APPLICATIONS

This application claims the benefit of U.S. Provisional Patent Application No. 60/698,803 filed on 12 Jul. 2005.

BACKGROUND OF THE INVENTION a. Field of the Invention

The present invention relates generally to bottle openers, and, more particularly, to a compact, ergonomic bottle opener which can be carried in a pocket or on a keychain and that is also suitable for advertising and promotional use.

b. Related Art

As used herein, the term "bottle opener" refers to a tool for the removal of standard crimped metal bottle caps, also known as crown caps, which are commonly found on bottled beverages such as beer, sparkling water and soft drinks. Furthermore, the terms forward and rearward, upper and lower, refer for case of illustration and clarity to the orientation of the opener as it is ordinarily held for the removal of a cap from a bottle.

Kitchen bottle openers are, of course, well known; however, portable openers are also desirable. Many prior bottle openers have been developed that are sufficiently compact to be carried in a pocket or on a keychain. Because of the substantial force required to remove a bottle cap, however, many of the prior types have been made entirely of metal, such as steel, die-cast zinc alloy, or powdered metal. Examples include those shown in U.S. Pat. Nos. 4,864,898 and 4,949,600 (to Yang), 5,077,850 (to Brubaker) and 4,653,354 (to Clapp). This form of construction makes them relatively expensive to produce and also quite heavy to carry. Some have been made of aluminum, which is lighter in weight, but aluminum is soft and prone to rapidly wearing out in the critical area that engages the cap.

Bottle openers have also been made of various plastic materials, but these invariably must have metal reinforcement in the critical area where the opener makes contact with the cap during removal, at least if they are expected to have a reasonable service life. For example, U.S. Pat. No. 4,433,597 (Rowland) teaches an opener that is made of both plastic and metal, while U.S. Pat. Nos. 4,864,818 and 4,949,600 (both to Tricinella) show plastic bottle openers having a metal blade insert.

A problem with many prior compact bottle openers is that they exhibit poor ergonomics and are quite difficult to use, often requiring two or more tries before the cap can be removed. One reason for the difficulty is a simple law of physics: An opener that is small enough to be suitable for carrying on a key chain (maximum length about 2.75 inches) can only provide a short lever arm, which requires more finger or hand strength than would a long one. Moreover, many prior compact bottle openers, unlike their bulky kitchen counterparts, are unable to form an adequate engagement with the underside of the bottom cap and therefore tend to slip off when lifted. Still further, many prior openers, although comparatively small in size, are cumbersomely shaped and do not nest well with keys on a common ring.

Yet another drawback of prior designs is that the openers are generally lacking in broad, flat areas for display of logos, advertising and so on. Key-ring bottle openers are commonly employed as promotional items, yet few prior openers provide anything more than a single, narrow surface or strip on which such information can be printed or otherwise applied.

Accordingly, there exists a need for a compact bottle opener that can be carried on a keychain that is inexpensive to produce and which has sufficient strength to effectively remove bottle caps. Furthermore, there exists a need for such an opener that is durable and long lasting in use. Still further, there exists a need for such an opener that has an ergonomic configuration so that caps can be removed without undue strain, to either the hand/wrist or fingers, despite the short lever arm inherent in a compact opener. Still further, there exists a need for such an opener that engages the edge of a cap in a secure manner so as to avoid the opener slipping off when it is raised to remove the cap from a bottle. Still further, there exists a need for such an opener that provides a large, prominent area or areas for displaying logos, advertising messages, and other information, making it especially suitable for promotional use.

SUMMARY OF THE INVENTION

The present invention has solved the problems cited above, and is a pocket-sized bottle opener having a flat, thin body with a jaw opening and also an area for at least one lifting finger formed on its lower edge.

The opener may comprise a thin, generally planar body formed of a substantially rigid material, the body having upper and lower edges and forward and rearward ends, a jaw opening formed in the lower edge of the body for engaging a cap on a bottle, a fulcrum portion formed on the lower edge of the body on a forward side of the jaw opening for pivoting against the top of a cap that is engaged by the jaw opening, and at least one concavely contoured finger receiving area formed on the lower edge of the body on a rearward side of the jaw opening, for receiving a lifting finger that raises the body while pivoting the fulcrum portion on the cap.

The fulcrum portion may comprise a depending, hook-shaped portion of the body having a pointed tip that extends rearwardly into the jaw opening. The hook-shaped portion may also be used to lift pull-tabs on cans.

The bottle opener may further comprise first and second broad, substantially flat display surfaces formed on sides of the body, intermediate the upper and lower edges thereof.

The bottle opener may further comprise a cushioning plug member that is mounted in the finger receiving area, the plug member being formed of a substantially soft, resiliently yielding material for cushioning the lifting finger while removing a cap. The cushioning plug member may comprise a concavely curved lower surface for engaging the lifting finger, the lower surface of the plug member having a width that is greater than a thickness of the planar body portion so as to form an increased area for contacting the finger. The cushioning plug member may further comprise raised texturing formed on the lower surface thereof for establishing additional frictional engagement with the lifting finger.

The opener may further comprise a thickened base portion formed on the lower edge of the body intermediate of the finger receiving area and the jaw opening, the base portion comprising a lower surface having a width greater than a thickness of the thin, planar body, so as to form an increased contact area for engaging a second lifting finger. The upper edge of the body, in turn, may comprise a generally linear edge portion for resting a thumb thereon.

The opener may further comprise a metal insert that is mounted to the thickened base portion, the metal insert comprising a lip portion that projects into the jaw opening for engaging a lower edge of a cap that is received therein. The base portion may further comprise a projecting shoulder portion that extends beneath the lip portion of the metal insert so as to support the lip portion against downward forces exerted when removing a cap.

The bottle opener may further comprise a ring opening formed proximate the rearward end of the body for retaining an attachment ring therein. The body may be formed of a resiliently flexible material, and may comprise an elongate leg portion that defines a rearward side of the ring opening, and a narrow slot that communicates with the ring opening and that separates a distal end of the leg portion from the body, so that the attachment ring can be slipped into the opening by deflecting the leg portion so as to open the slot.

The cushioning plug member may further comprise an attachment portion that mounts over the distal end of the leg portion and also the lower edge of the body, so as to prevent the leg portion from being deflected after the ring has been installed.

The body of the opener may be formed of a strong, molded plastic material. The cushioning plug may be formed of a molded elastomeric material, such as soft plastic or synthetic rubber.

These and other features and advantages of the invention will be more fully understood from a reading of the following detailed description with reference to the accompanying drawings.

DETAILED DESCRIPTION

Figure 1:
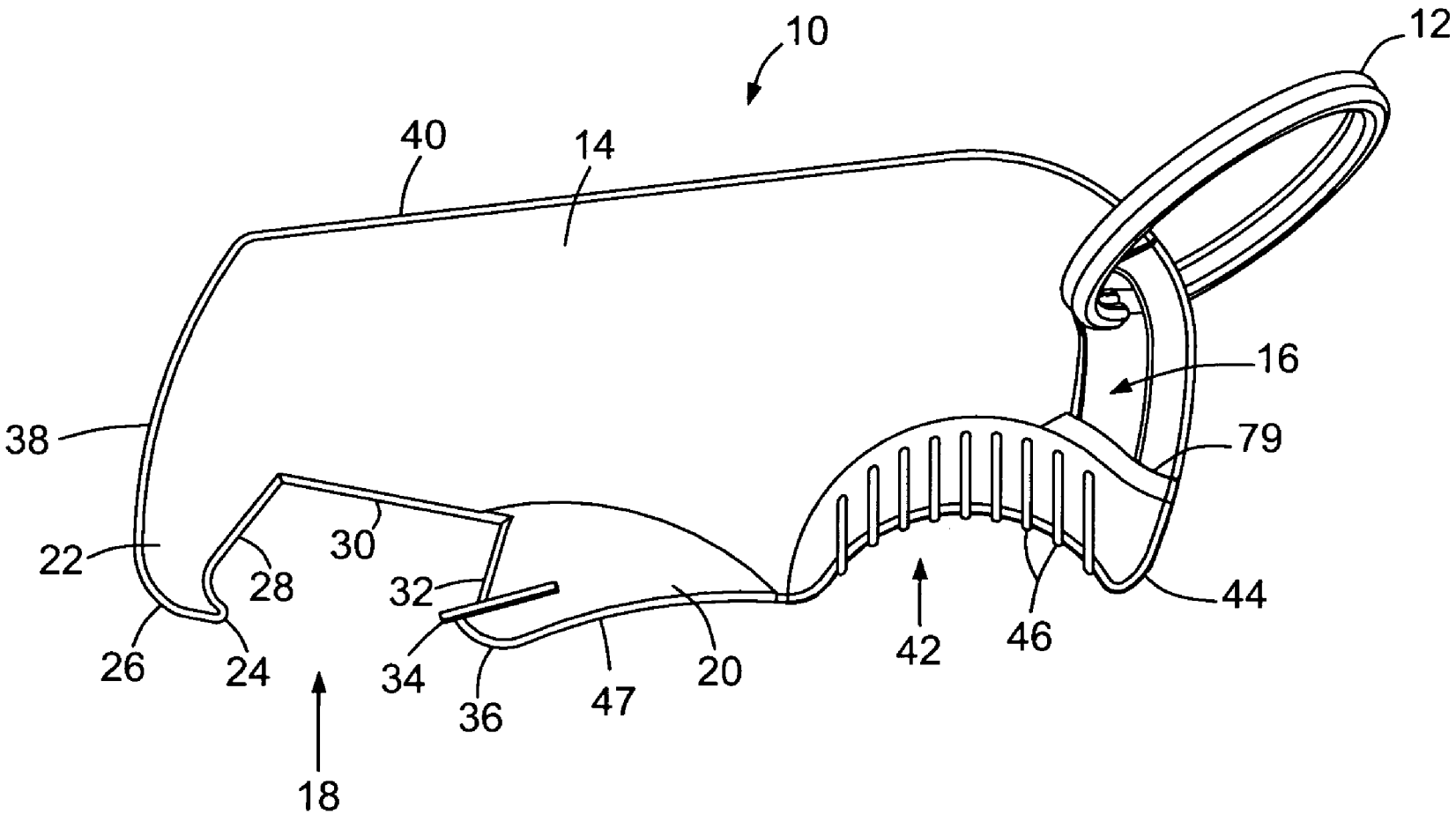
FIG. 1 is a side, elevational view of a compact bottle opener in accordance with the present invention.

FIG. 1 shows a bottle opener 10 in accordance with the present invention, with an installed key ring 12. As can be seen, the principal component of the opener is a thin, generally planar main body 14 that is molded of a strong but slightly flexible plastic material such as polycarbonate or nylon. The main body is somewhat elongate, with a ring opening 16 at the rearward end and a jaw opening 18 proximate the forward end. The main body has a substantially uniform thickness, except for a thickened, outwardly tapered portion 20 at the rear of the jaw opening, the function of which will be described in greater detail below.

The forward side of the jaw opening is defined by a depending hook portion 22 that, as will be described below, serves to form a fulcrum against the top of the bottle cap. As can be seen in FIG. 1 and also FIG. 2, the hook portion terminates in a pointed tip 24 that projects rearwardly into the jaw opening 18, and that is bordered on its lower side by a curved, arcuate surface 26. An inside forward edge 28 of the opening extends at an upward and rearward angle, diverging from the forward edge of the body so that the hook portion 22 broadens towards its upper end. The forward edge 28 extends to the top edge 30 of the opening, which is angled downwardly and rearwardly at a relatively shallow angle. The rearward edge 32, in turn, extends at a downward and forward angle. In combination, the edges 28, 30, 32 define an opening having sufficient clearance to engage a bottle cap, as will be described in greater detail below. It will be understood, however, that inside edges having other geometries may be used to form a jaw opening having the necessary clearance.

At the bottom of the rearward edge 32, flat metal blade insert 34 projects forwardly into the jaw opening 18 at a relatively shallow angle. In the preferred embodiment that is illustrated, the included angle between the blade and the tip 24 of the hook portion is approximately 150°. The rearward end of the metal blade member is mounted to the thickened base portion 20 of the body, a projecting shoulder 36 of which extends beneath the forwardly projecting lip of the insert to provide additional support. The thickened base portion 20 consequently provides a strengthened area that supports the insert 34, without having to increase the thickness/bulk of the entire body.

Forward of the hook portion 22, a curvilinear front edge 38 of the body extends upwardly and rearwardly towards upper edge 40. As will be described in greater detail below, the curved forward edge 38 facilitates use of the hook portion 22 to lift the pull-tabs of beverage cans and the like.

A concave finger notch 42 is formed rearwardly of the jaw opening 18, proximate the rearward end of the body 14. As will be described in greater detail below, the finger notch is fitted with a contoured cushioning plug 44 formed of a soft, resiliently yielding material. The plug member, and in particular its lower surface, has a width/thickness somewhat greater than the thickness of the main body 14, and is preferably provided with ribs 46 or other surface texturing on its bottom and side surfaces; in the preferred embodiment that is shown, the protruding, parallel ridges have the advantage of complementing the cushioning and comforting functions of the resilient material of the plug member.

Figure 2:
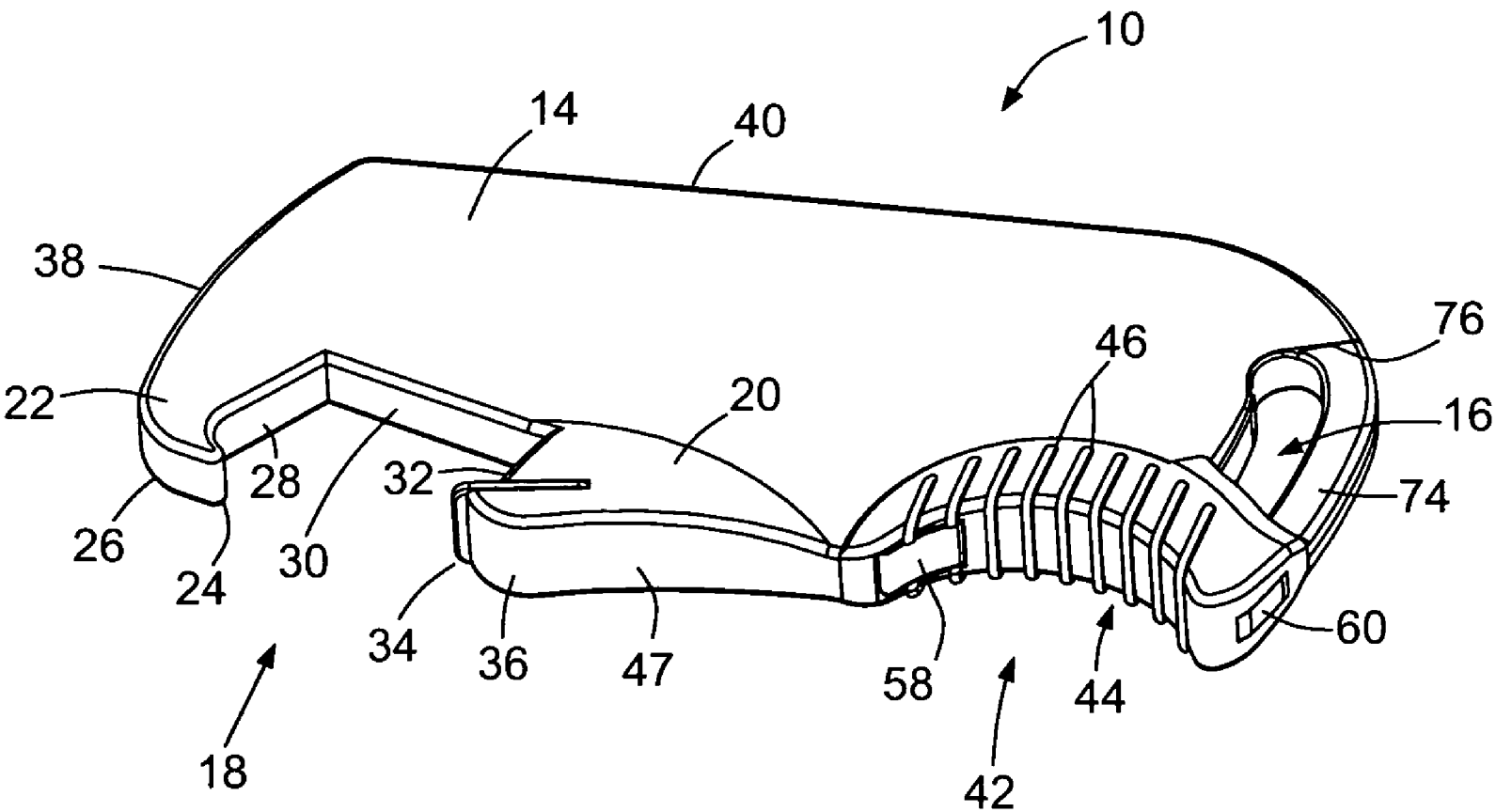
FIG. 2 is a bottom, perspective view of the compact bottle opener of FIG. 1, without the attachment ring, showing the finger engagement portions of the opener in greater detail.
Figure 3:
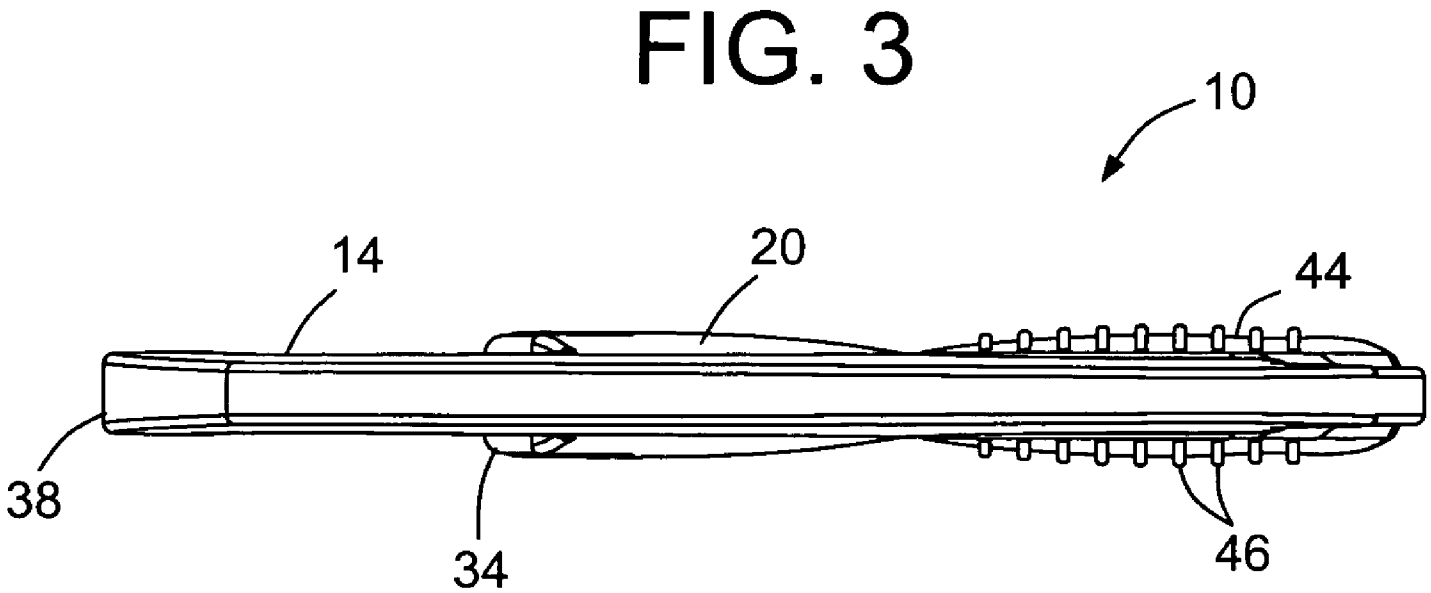
FIG. 3 is a top, plan view of the compact bottle opener of FIG. 1, showing the relative thickness/width of the main body and finger engagement portions thereof in greater detail.

The contoured recess of the cushioning plug member receives the finger that exerts the main lifting force when removing a bottle cap. When that finger is the middle finger of the hand, the index finger can in turn be rested against the relatively broad lower surface 47 of the tapered base portion 20 to provide additional lifting force. As can be seen in FIG. 2 and also FIG. 3, the bottom surface of the base portion 20 (due to its outward taper) has a width that is greater than the thickness of the main body and that is similar to the width of the cushioning plug 44.

The resilient cushioning action of the plug 44 eliminates the momentary pain that is sometimes experienced in the lifting finger when using prior types of compact openers; owing to the short lever arm and the significant lifting force that must be exerted. Moreover, the broadened surfaces on the bottoms of the plug and base portion, which distribute loads out onto the fingers, permit the main body 14 to have a flat, thin configuration, without the problem of a thin narrow lower edge that would tend to cut into the lifting finger or fingers. The thin, flat overall configuration of the body provides several advantages in turn, including the ability to nest compactly with conventional keys (which likewise have a thin, flat configuration) and the creation of broad side surfaces for displaying advertising, logos, or other information. Furthermore, the ability to use polycarbonate plastic or similar materials (e.g. nylon), in transparent/translucent and/or vividly colored forms, adds significantly to the market appeal of the product.

The cushioning plug itself is suitably formed of resiliently yielding TPE (thermo-plastic elastomer) material; soft, resiliently yielding PVC is also suitable, although for regulatory and other reasons it is less desirable for many markets.

Figure 4:
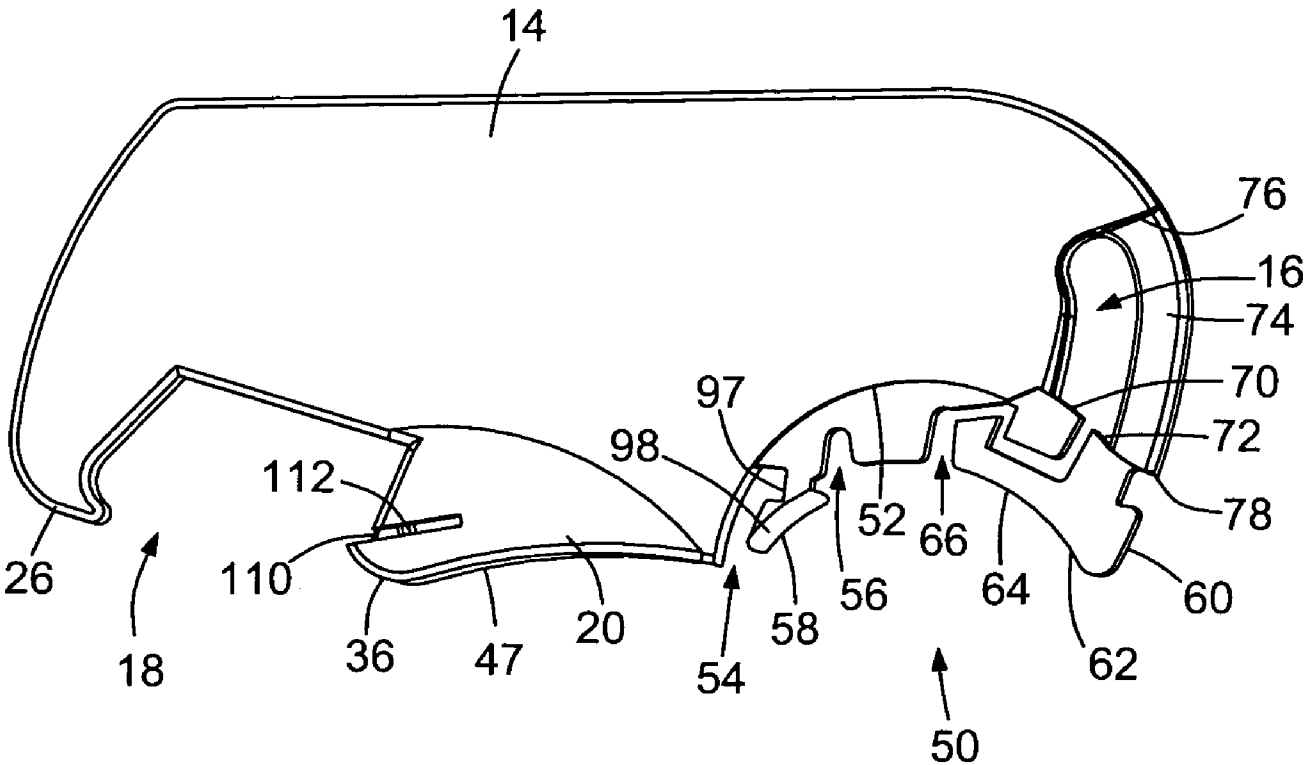
FIG. 4 is a side, elevational view of the molded plastic body of the compact bottle opener of FIG. 1, showing the structure thereof in greater detail.

FIG. 4 shows the main body 14 of the opener, without the other components. As can be seen, the structure in the area 50 that underlies the cushioning plug member includes a number of projections and indentations that (a) engage and support the plug member, and (b) allow the key ring to be slipped into opening 16 before attaching the plug member.

As can be seen in FIG. 4, steps or shoulders 52 on the sides of the body define the upper edges of the mounting area, below which the material has a significantly reduced thickness, i.e., the material of the body 14 is thicker above the steps 52 and generally thinner below.

As can be seen with further reference to FIG. 4, the mounting area includes a downwardly-extending projection that is bordered on its forward and rearward sides by upwardly extending openings 54, 56, and that is capped on its lower end by a contoured plate 58 having projecting edges. A second, heel shaped projection 60 is formed at the rear of the mounting area, but has the same reduced thickness as the other portions below the shoulders 52. As will be described below, the plate and heel projections form locking structures that secure the cushioning plug to the mounting area. Moreover, the contoured shape of the plate 58, which is exposed at the bottom of cushioning plug (see FIG. 2), ensures that it will not be felt uncomfortably in the event that it is contacted by the lifting finger.

The heel shaped projection 60 is formed at the rearward end of a downwardly extending L-shaped flange portion 62 having a curvilinear lower edge 64. At its forward end, the flange portion is bordered by an upwardly extending opening 66 that is generally similar to opening 56 and likewise has a curved, generally U-shaped upper end. In the case of the rearward opening, however, a slot 68 extends rearwardly from its upper end and then along a somewhat U-shaped path so as to enter and communicate with the lower end of the ring opening 16. The forward end of the flange portion 62 therefore has a somewhat hook-shaped configuration, and is free from attachment to the overlying material of the main body. Where the slot 68 enters the opening 16, it is narrower than the edge of the key ring 12, and is flanked by inwardly projecting shoulders 70, 72; given the limitations of existing technology, the slot is limited to a minimum width of about 0.8 mm (rather than being a mere slit or having the edges in direct contact), in order to avoid the use of impracticably thin and delicate walls within the mold.

The rearward side of the ring opening 16, is defined by a curved, downwardly extending leg portion 74. At its upper end, shallow steps 76 join the leg portion to the main body 14, while at its lower end additional shoulders 78 step the thickness down to that of the foot 62 and heel portion 60. The leg portion 74 consequently has a thickness intermediate that of the main body 14 and the thinner portions which lie below the border 52.

The reduced thickness of the leg portion 74 gives it increased flexibility without compromising the overall rigidity of the main body 14. This enables the leg portion 74 to be deflected/bent (i.e., in a lateral/sideways direction out of the plane of FIG. 4) quite easily, so that the foot portion 62 swings away from the main body. This, in turn, opens the slot 68, so that the key ring 12 can be slipped over the hook-shaped foot portion and into the opening 16. The leg portion 74 is then released to return resiliently to the position that is shown in FIG. 4, closing the slot 68 so as to retain the ring within opening 16. In this orientation, the inwardly projecting shoulders 70, 72 at the bottom of the main opening are positioned on either side of the channel opening (which, as noted above, is narrower than the edge of the ring), so that forces tending to pull the ring out of the opening are borne by the more rigid material of the shoulders rather than that of the cushioning plug, thus preventing the ring from acting to pull the plug off of the body or digging into and damaging the resilient material thereof.

Installing the split ring 12 in the manner described above, by bending the leg portion 74 so that the ring can be slipped into opening 16, can be performed very quickly and easily by an operator during assembly of the opener. Since the openers are ordinarily supplied by the manufacturer with the key ring installed, this avoids the necessity of the operator having to pry the split ring open and feed the spiral through the opening (requiring incremental turning motions through approximately 360 degrees), which is a slow and laborious process that adds significant time/cost to the production of prior types of openers.

Figure 7:
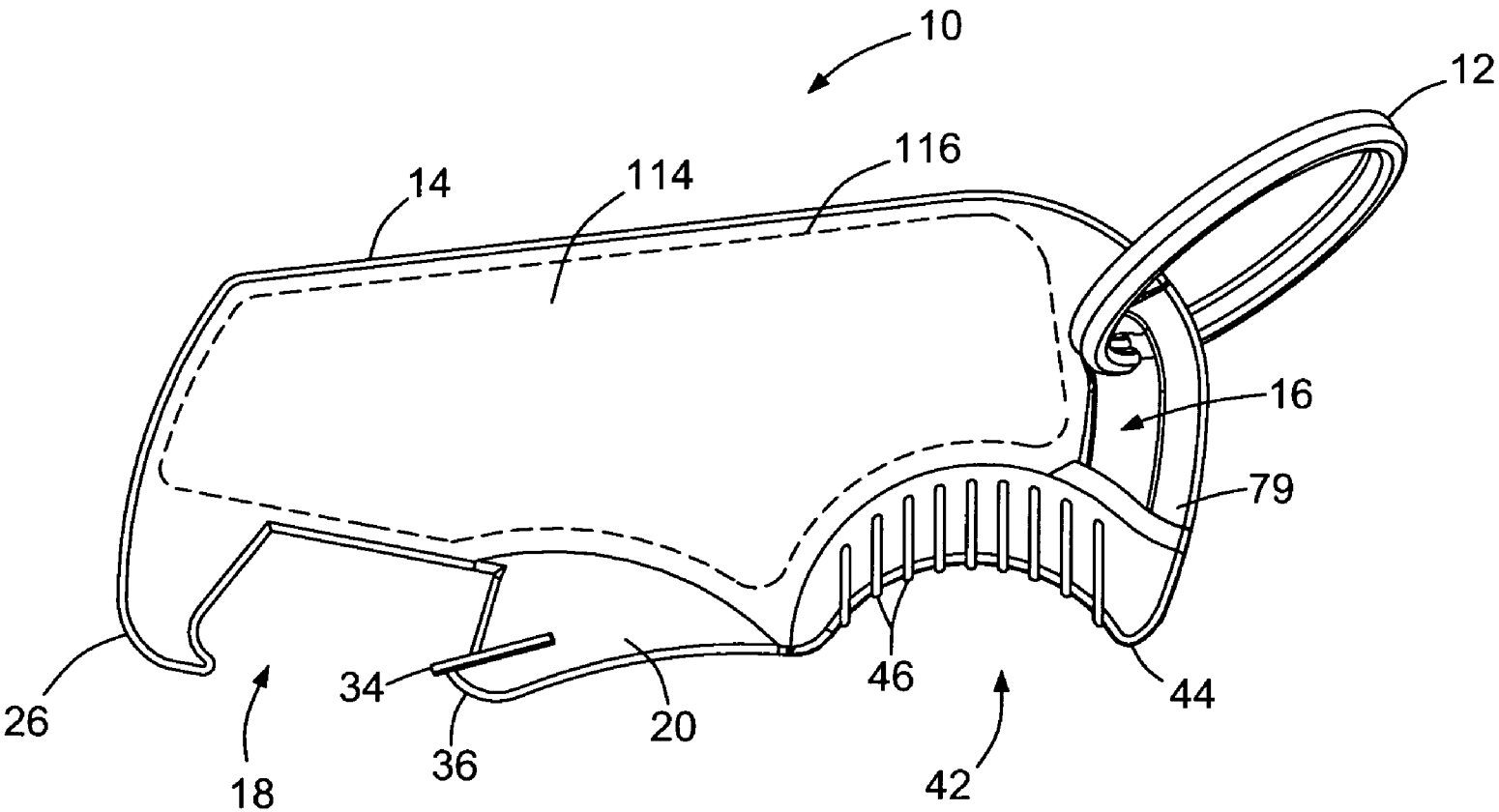
FIG. 7 is a side, elevational view of the compact bottle opener of FIG. 1, showing the area to which an advertising message, logo, or other information can be applied.

After the split ring has been installed in the opening 16, the resilient plug member 44 is mounted to the area 50 at the bottom of the body 14. In so doing, the plug member mounts over both the foot portion 62 and the lower edge of the main body, which retains the leg and foot portions from being inadvertently bent in a manner that would allow ring 12 to fall out of its opening. Moreover, as can be seen in FIGS. 1 and 7, the upper lip 79 at the rear of the cushioning plug fits closely against the shoulders 78 at the bottom of the leg portion, ensuring a precise fit between the two parts.

Figure 5:
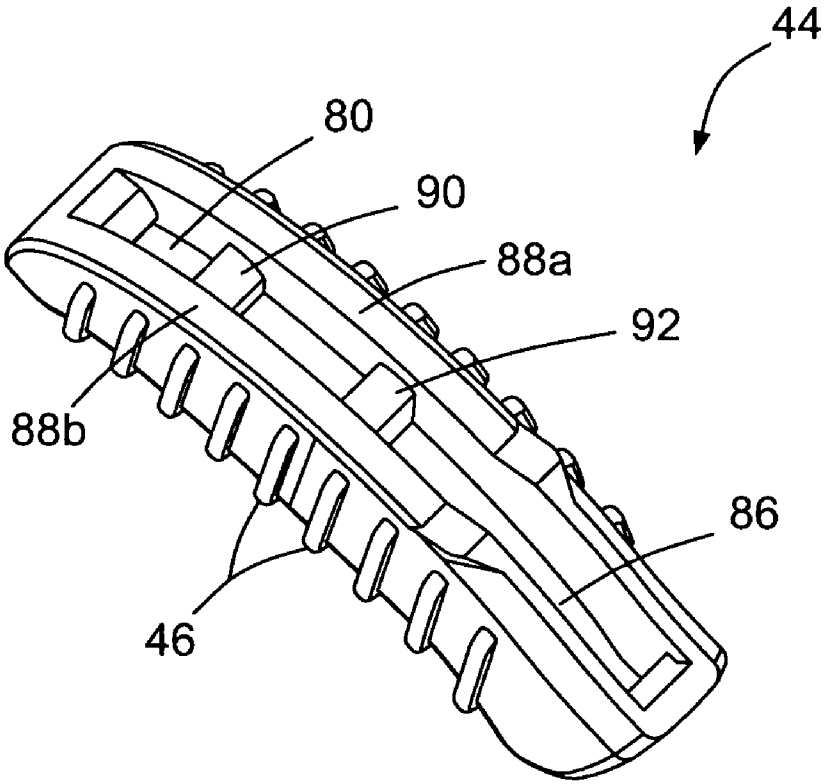
FIG. 5 is a top, perspective view of the cushioning plug of the finger grip of the bottle opener of FIG. 1, showing the mounting structure thereof in greater detail.
Figure 6:
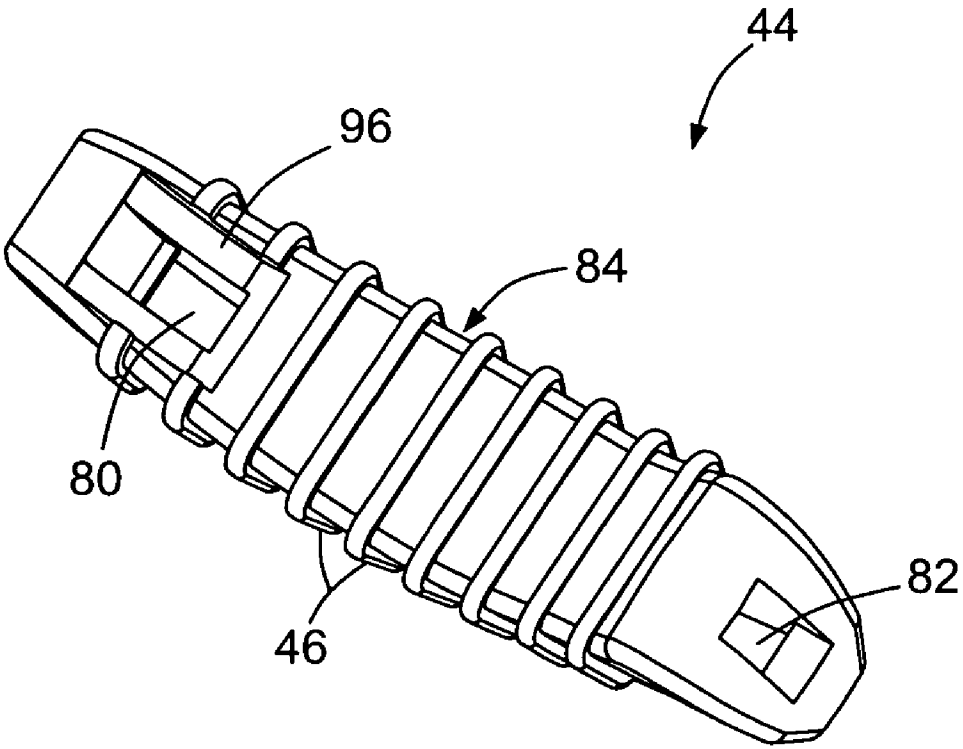
FIG. 6 is a bottom, perspective view of the cushioning plug of FIG. 5, showing the ribbed exterior thereof in greater detail.

The configuration of the components allows mounting of the plug to likewise be performed in an expeditious and efficient manner; as can be seen in FIGS. 5-6, the cushioning plug member 44 includes forward and rearward openings 80, 82 that are formed through the body 84 of cushioning material. The openings are at the ends of an elongate central channel 86, that is bordered by longitudinal sidewalls 88*a*, 88*b* having curvilinear upper edges that correspond to and fit against the shoulders 52 on the plastic body 14; the width of the channel 86 is slightly narrower than the thickness of the material in the mounting area, so that the insert will form a frictional engagement therewith along the entire length of the plug.

Moreover, as can be seen in FIG. 5, forward and rearward raised, transversely extending ribs 90, 92 project upwardly from the bottom of the channel to proximate the upper edges of the sidewalls 88*a*, 88*b*, the upper ends of the ribs having a generally convex curvature that corresponds to that of the openings on the bottom of the mounting area. When the cushioning plug is installed on the mounting area of the body, the ribs 90, 92 "bottom out" in the corresponding openings so as to stabilize the plug when subjected to lifting forces; in particular, although the L-shaped leg portion is slightly flexible in an up-and-down direction due to the existence of the slot 68, the engagement of the ribs 90, 92 with the openings and the frictional engagement of the channel with the sides of the mounting area ensure that this does not result in a flexing action that would interfere with the lifting function of the opener.

In order to install the cushioning plug member 44, the operator takes hold of the body and plug, and slips the projecting heel 60 at the rear of the body through the rearward opening 82 of the plug member. The operator then presses the forward end of the plug upwardly against the bottom of the body, so that the base plate 58 on the bottom of the forward projection is forced through the forward opening 80 of the plug member; in so doing, the resilient, elastomeric material of the plug member stretches and allows opening 80 to expand so as to permit passage of the base plate therethrough. Continued movement of the forward end of the plug in an upward direction brings the opening 80 into register with the narrower depending support 97 of plate 58. Opening 80 is sized and shaped to correspond to strut 97, so that the material of the plug member will return substantially to its initial configuration. In so doing, the surface 96 of the recess that is formed about the lower end of opening 80 "snaps" into position above and in abutting relationship with the upper surface 98 of the bottom plate 58, so as to prevent the forward end of the plug member from being pulled back off of the body in a downward direction. At the same time, the upwardly projecting ribs 90, 92 enter and engage the correspondently shaped openings 56, 66 so as to hold the cushioning plug member against shifting in a forward-rearward direction during use of the opener.

Accordingly, the cushioning plug member 44 can be installed on the body in a very rapid and efficient manner, by simply pressing the plug member in a generally forward and upward direction. This, in combination with the "slip-in" installation of the key ring, greatly facilitates rapid and economical assembly of the opener. Moreover, mounting of the plug member does not require use of glue or other adhesives; this is a significant advantage, not only from the standpoint of reduced manufacturing costs, but also in view of the poor reliability of existing adhesives when used with plastic and synthetic rubber materials.

Figure 8:
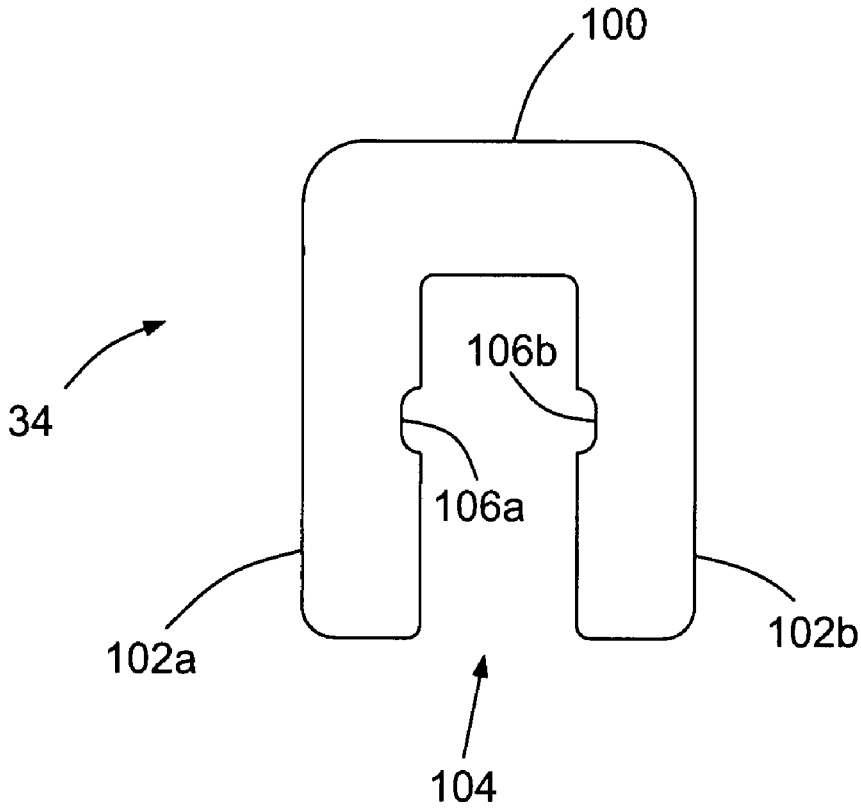
FIG. 8 is an enlarged, plan view of the metal insert that forms the contact surface for engaging the edge of a bottle cap.

The final component of the opener assembly is the metal insert 34 in the jaw. As can be seen in FIGS. 1 and 8, the insert is a flat, plate-like member, suitably formed by punching, stamping or cutting from steel sheet material. The steel material is preferably hardened to provide strength and durability. Moreover, as can be seen in FIG. 8, the insert has a generally U-shaped overall configuration, with a forward lip portion 100, and parallel, rearwardly extending leg portions 102*a*, 102*b* that define a longitudinal opening 104. First and second notches 106*a*, 106*b* are formed along the inside edges of the two-leg portions, partway along the length of opening 104.

As can be seen in FIG. 4, parallel slots 110 are formed in the depending base portion of the body, just above the projecting shoulder 36, each including a raised, transversely extending rib 112 formed partway along its length. In order to install the metal insert, the two leg portions are slipped into the slots 110 and the insert is pressed rearwardly. As this is done, the leg portions of the insert spread slightly to pass over the transverse ribs 112, and also dig or "chew" partway into the material of the ribs. When the insert reaches its rearward limit, the notches 106*a*, 106*b* on the inside edges of the leg portions move into register with the raised ribs 112, at which point the leg portions "snap" resiliently back to their original configuration, so that the insert is locked in place by a combination of mechanical and frictional engagement with the ribs. Thus, the configuration of the components enables installation of the metal insert to be performed in a very rapid and efficient manner as well.

As was noted above, the flat configuration of the body 14 provides a large display area for application of advertising, logos, or other information. FIG. 7 shows the display areas 114, as indicated by dashed-line border 116. The printing or other information can be applied to the display area by screen printing, hot stamping, pad printing, or other suitable means.

Figure 9:
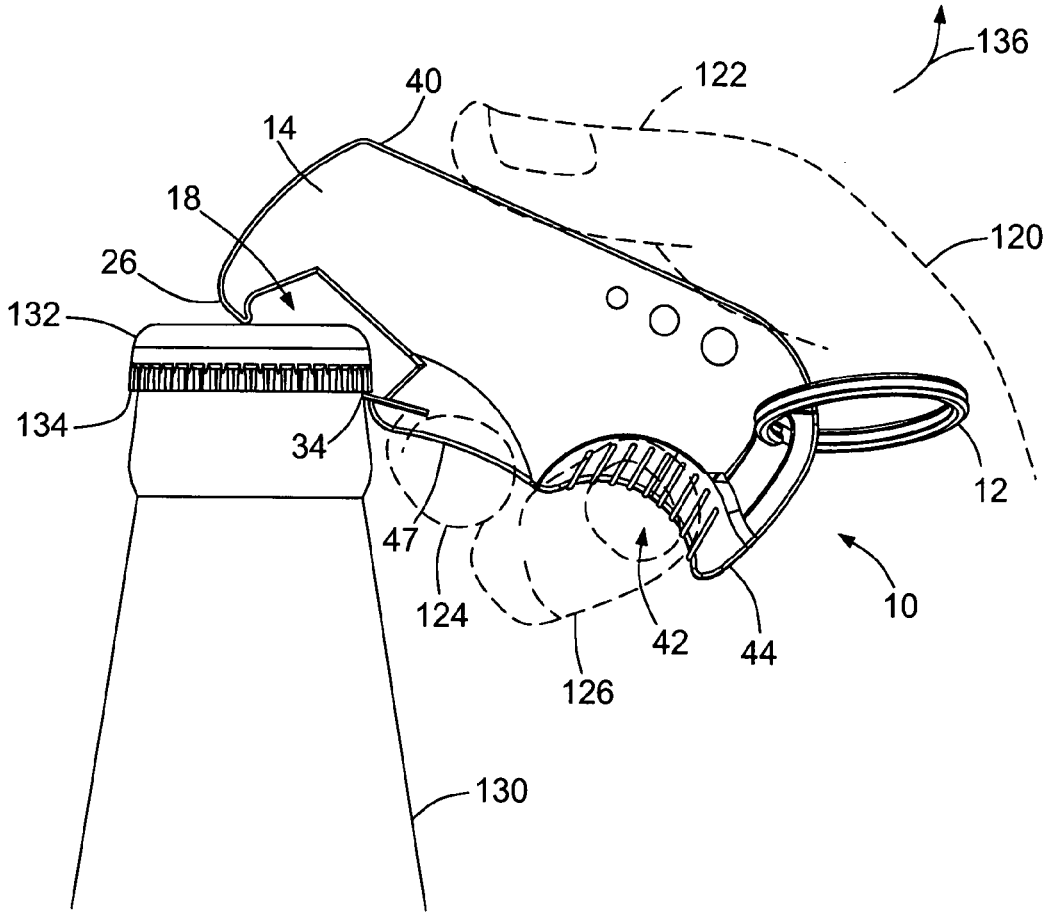
FIG. 9 is a plan, environmental view of the bottle opener of FIG. 1, showing the manner in which the opener is grasped in the hand, and the manner in which it engages a bottle cap when being used to remove the latter.

Use of the bottle opener of the present invention is illustrated in FIG. 9. As can be seen, the body 14 of the opener is gripped in the user's hand 120, with the thumb 122 resting atop a portion of the upper edge of the body and the index and/or middle fingers 124, 126 wrapped around the bottom edge; the middle finger may be placed in the rearward receiving area 42 (against the cushioning plug 44) to provide the main lifting force and the index finger may be positioned against the forward, widened bottom surface 47 of the base portion 20 to perform a stabilizing function, in a "three-finger" grip as shown in FIG. 9, or the index (or middle) finger alone may be positioned in the rearward area to establish a "two-finger" grip.

Thus held, the opener is positioned against the top of a bottle 130, as shown in FIG. 9, so that the edge of the cap 132 enters the jaw opening 18. In this position, the forward lip of the metal insert 34 slips under the depending edge 134, and the pointed tip 24 of the hook portion 22 bears against the top of the cap to form a fulcrum; preferably, the hook portion is sized so that the fulcrum is established directly at the cap's center. The user's hand is then lifted in the direction indicated by arrow 136, raising the edge of the cap and removing it from the bottle.

As was noted above, the hook portion 22 can also be employed to lift the pull-tabs of beverage cans and the like, a feature that is especially helpful to people with long or delicate finger nails. This is done by inserting the tip 24 of the hook portion under the pull-tab, and "rolling" the curved edges 26, 38 of the opener against the top of the can. Once the tab has been lifted, it can be conveniently grasped between the fingers and pulled so as to complete the opening action.

By way of example, without limitation, approximate dimensions suitable for an opener having the preferred construction described above are as follows: length—2.75 inches (7 cm), height—1.25 inches (3 cm), thickness of main body—0.125 inch (0.3 cm), jaw opening—0.75 inch (2 cm), length of finger engagement surfaces—0.75 inch (2 cm); width of finger engagement surfaces—0.25 inch (0.7 cm), weight exclusive of key ring—0.25 oz (8 gm).

It is to be recognized that various alterations, modifications, and/or additions may be introduced into the constructions and arrangements of parts described above without departing from the spirit or ambit of the present invention as defined by the appended claims.

What is claimed is:

1. A bottle opener, comprising:

a thin, generally planar body formed of a substantially rigid material, said body having upper and lower edges and forward and rearward ends;

a jaw opening formed in said lower edge of said body proximate said forward end, for engaging a cap on a bottle;

a fulcrum portion formed on said lower edge of said body on a forward side of said jaw opening, for pivoting against a top of a cap that is engaged by said opening;

at least one concavely contoured finger receiving portion formed on said lower edge on a second side of said jaw opening, for lifting said body of said opener while pivoting said fulcrum portion on a cap that is engaged by said jaw opening so as to remove said cap from said bottle; and a cushioning plug member mounted in said finger receiving area, said plug member being formed of a substantially soft, resiliently compressible material for cushioning a lifting finger when removing a cap from a bottle.

2. The bottle opener of claim 1, wherein said fulcrum portion comprises:

a depending hook-shaped portion of said body having a pointed tip that extends rearwardly into said jaw opening.

3. The bottle opener of claim 1, further comprising:

first and second broad, substantially flat display surfaces formed on sides of said body intermediate said upper and lower edges thereof.

4. The bottle opener of claim 1, wherein said cushioning plug member comprises:

a concavely curved lower surface for engaging a lifting finger, said lower surface of said plug member having a width that is greater than a thickness of said planar body portion so as to form an increased area for distributing loads into said lifting finger.

5. The bottle opener of claim 4, wherein said cushioning plug member further comprises:

raised texturing formed on said lower surface of said plug member for establishing frictional engagement with said lifting.

6. The bottle opener of claim 1, further comprising:

a thickened base portion formed on said lower edge of said body intermediate said finger receiving area and said jaw opening, said thickened base portion comprising a lower surface having a width greater than a thickness of said thin, planar body so as to form an increased area for distributing loads into a second lifting finger when removing a cap from a bottle.

7. The bottle opener of claim 6, wherein said upper edge of said body comprises:

a substantially linear edge portion for resting a thumb thereon while removing a cap from a bottle.

8. The bottle opener of claim 6, further comprising:

a metal insert that is mounted to said thickened base portion, said metal insert comprising a lip portion that projects into said jaw opening for engaging a lower edge of a cap that is received in said opening.

9. The bottle opener of claim 8, wherein said thickened base portion further comprises:

a projecting shoulder portion that extends beneath said lip portion of said metal insert so as to support said lip portion against downward forces when removing a cap from a bottle.

10. The bottle opener of claim 1, further comprising:

a ring opening formed proximate said rearward end of said body for retaining an attachment ring therein.

11. The bottle opener of claim 10, further comprising:

an elongate leg portion of said body that defines a rearward side of said ring opening; and a narrow slot that communicates with said ring opening and that separates a distal end of said leg portion from said body;

said body being formed of a substantially rigid, resiliently flexible material, so that said distal end of said leg portion can be deflected to open said slot so that said key ring can be slipped therethrough into said ring opening.

12. The bottle opener of claim 1, further comprising:

a ring opening formed proximate said rearward end of said body for retaining an attachment ring therein.

13. The bottle opener of claim 12, wherein said cushioning plug member further comprises:

an attachment portion that mounts over said distal end of said leg and also said lower edge of said body, so as to prevent said leg portion from being displaced laterally after said attachment ring has been installed in said opening.

14. The bottle opener of claim 1, wherein said body is formed of strong, molded plastic material.

15. A bottle opener, comprising:

a body formed of a substantially rigid, resiliently flexible material;

a jaw opening for engaging a cap to be removed from a bottle;

a leg portion of said body that defines a ring opening for retaining an attachment ring therein;

a narrow slot that communicates with said ring opening and that separates a distal end of said leg portion from said body, so that said attachment ring can be installed in said ring opening by deflecting said leg portion so as to open said slot and slipping said attachment ring therethrough into said opening; and means for preventing said leg portion of said body from being deflected after said attachment ring has been installed in said ring opening, said means for preventing said leg portion from being deflected comprising a cushioning plug member that mounts over an edge of said body and also said distal end of said leg portion.

16. A bottle opener, comprising:

a thin, generally planar body formed of a substantially rigid material, said body having upper and lower edges and forward and rearward ends;

a jaw opening formed in said lower edge of said body proximate said forward end, for engaging a cap on a bottle;

a fulcrum portion formed on said lower edge of said body on a forward side of said jaw opening, for pivoting against a top of a cap that is engaged by said opening;

at least one concavely contoured finger receiving portion formed on said lower edge on a second side of said jaw opening, for lifting said body of said opener while pivoting said fulcrum portion on a cap that is engaged by said jaw opening so as to remove said cap from said bottle; and a thickened base portion formed on said lower edge of said body intermediate said finger receiving area and said jaw opening, said thickened base portion comprising a lower surface having a width greater than a thickness of said thin, planar body so as to form an increased area for distributing loads into a second lifting finger when removing a cap from a bottle.

17. The bottle opener of claim 16, further comprising:

a metal insert that is mounted to said thickened base portion, said metal insert comprising a lip portion that projects into said jaw opening for engaging a lower edge of a cap that is received in said opening.

18. The bottle opener of claim 17, wherein said thickened base portion further comprises:

a projecting shoulder portion that extends beneath said lip portion of said metal insert so as to support said lip portion against downward forces when removing a cap from a bottle.

19. A bottle opener, comprising:

a thin, generally planar body formed of a substantially rigid material, said body having upper and lower edges and forward and rearward ends;

a jaw opening formed in said lower edge of said body proximate said forward end, for engaging a cap on a bottle;

a fulcrum portion formed on said lower edge of said body on a forward side of said jaw opening, for pivoting against a top of a cap that is engaged by said opening;

at least one concavely contoured finger receiving portion formed on said lower edge on a second side of said jaw opening, for lifting said body of said opener while pivoting said fulcrum portion on a cap that is engaged by said jaw opening so as to remove said cap from said bottle;

a ring opening formed proximate said rearward end of said body for retaining an attachment ring therein;

an elongate leg portion of said body that defines a rearward side of said ring opening; and a narrow slot that communicates with said ring opening and that separates a distal end of said leg portion from said body;

said body being formed of a substantially rigid, resiliently flexible material, so that said distal end of said leg portion can be deflected to open said slot so that said key ring can be slipped therethrough into said ring opening.

* * * * *